United States Patent [19]

DeWitt

[11] 4,281,793

[45] Aug. 4, 1981

[54] WATER SPRINKLER WITH FLAT PLATE PATTERN CONTROL

[76] Inventor: Robert E. DeWitt, 49 Sherwick Rd., Oswego, Ill. 60543

[21] Appl. No.: 115,263

[22] Filed: Jan. 25, 1980

Related U.S. Application Data

[63] Continuation-in-part of Ser. No. 51,861, Jun. 25, 1979, which is a continuation-in-part of Ser. No. 893,268, Apr. 5, 1978, Pat. No. 4,180,210.

[51] Int. Cl.[3] ..... B05B 3/06

[52] U.S. Cl. ..... 239/11; 239/97; 239/230; 239/252; 239/396; 239/DIG. 1

[58] Field of Search ..... 239/97, 98, 230, 252, 239/396, 569, DIG. 1, 1, 11

[56] References Cited

U.S. PATENT DOCUMENTS

| | | | |
|---|---|---|---|
| 2,600,987 | 6/1952 | Gallice | 239/97 |
| 2,739,839 | 3/1956 | Greener et al. | 239/97 |
| 3,884,416 | 5/1975 | King | 239/97 |
| 4,019,686 | 4/1977 | Palma | 239/DIG. 1 |

*Primary Examiner*—Andres Kashnikow
*Assistant Examiner*—Michael J. Forman
*Attorney, Agent, or Firm*—Cook, Wetzel & Egan, Ltd.

[57] ABSTRACT

A vertical-axis water sprinkler with a reversibly rotating spray head has an internal control shell rotating with the spray head in a fixed housing. Adjustably fixed in the housing are a plurality of pattern defining plates. A pattern sampling disk with a specially contoured aperture therein is carried on a control shell within the housing and communicates from a water inlet in the housing to the spray head. The aperture sweeps across the face and edge of each of the pattern defining plates as the control shell rotates in the housing. The positions of the pattern defining plates control or limit the volume of water flow to the spray head, thereby generating a ground coverage pattern conforming to the relative positions of the plates.

The speed of rotation of the spray head is made constant despite changes in the output flow rate by design selection of a friction bearing and of the surface areas of the control shell exposed to pressure forces in upward and downward directions.

Water supply pressure variations are accommodated in one embodiment by a plurality of pattern sampling apertures in a sampling disk coupled to a pressure selector disk having a single aperture radially aligned with the spray nozzle of the sprinkler head. Momentary engagement of the sampling disk to the housing permits rotating the spray head affixed to the control shell to change the aperture selected.

19 Claims, 13 Drawing Figures

32
33
31
35
34
36
30
37
38
41
39
40
20
75
72
55
58
59
27
80
72
75
76
21
73
74
90
48
III
52
46
II
II
71
71
26
50
26
70
45
70
61
47
49
60
70
56
51
57
III
70
24
23
25
22

70

52
50
51
49
46
32
25
61
60
70
50
70

74
71
26
48
47
49
52
70
60

Fig. 4
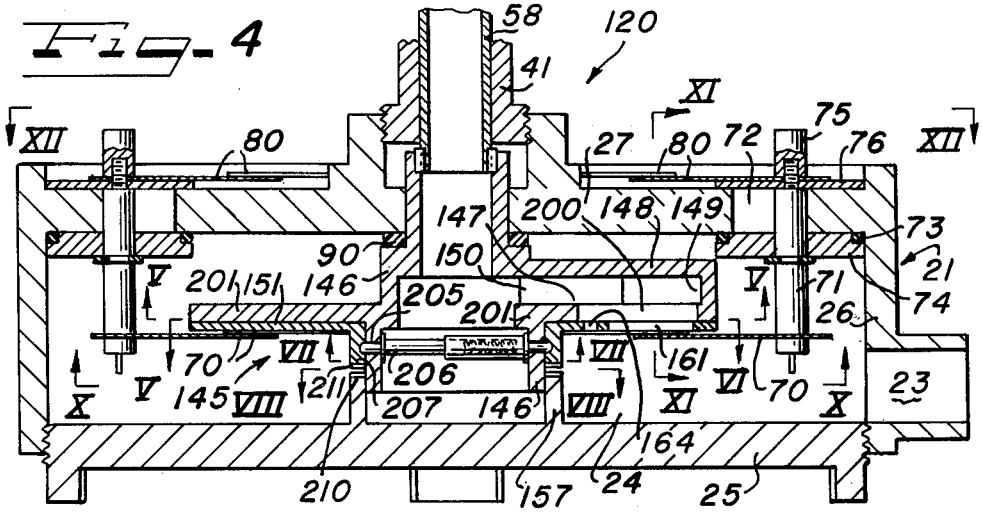
Fig. 5
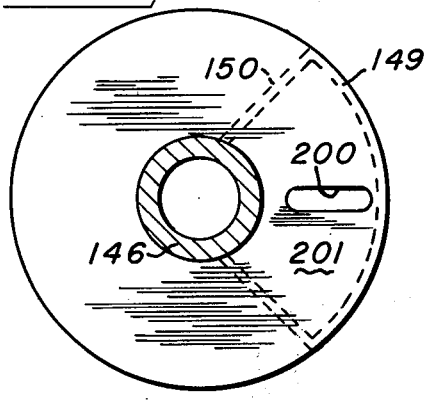
Fig. 6
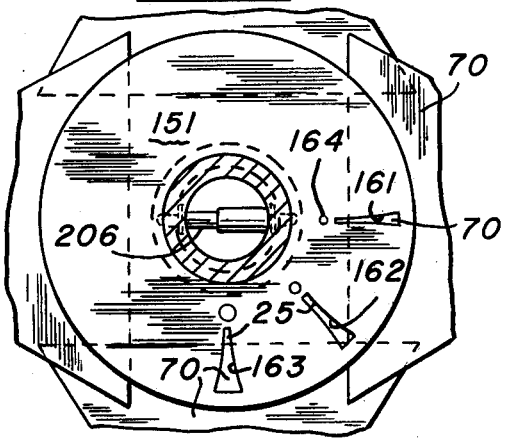
Fig. 7
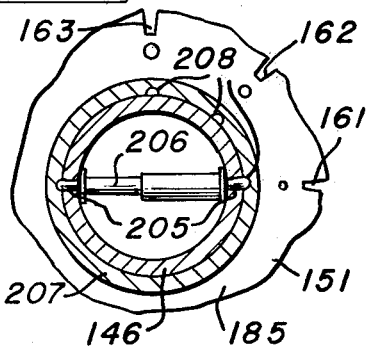
Fig. 8
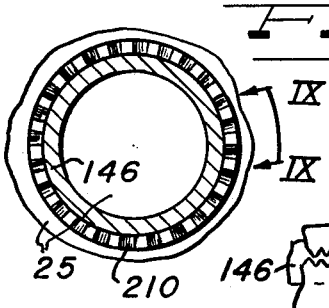
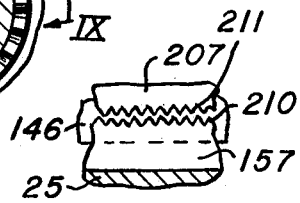
Fig. 9

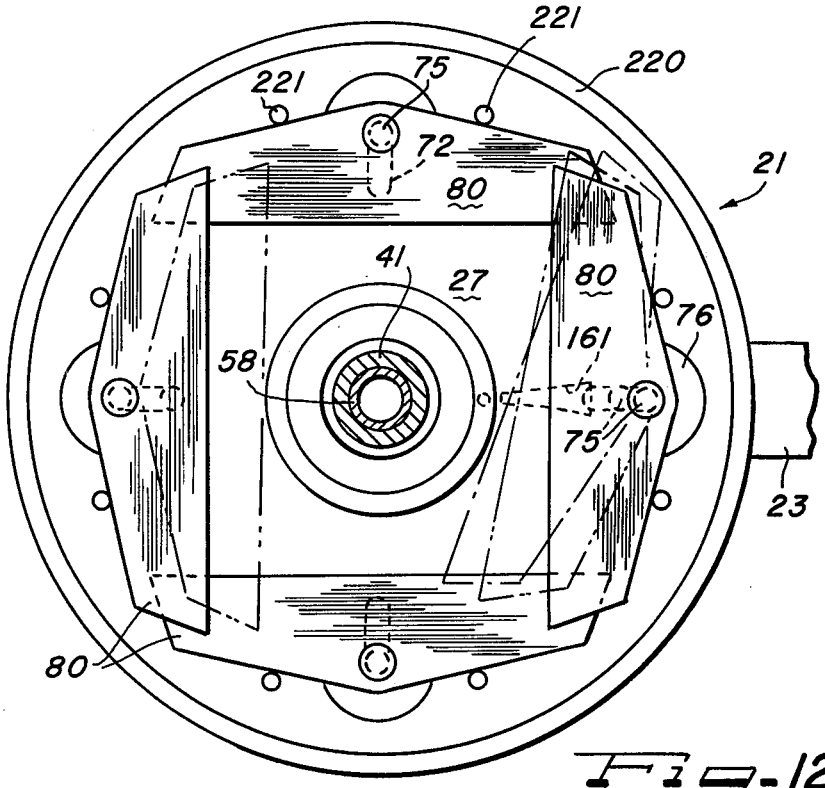
Fig-12
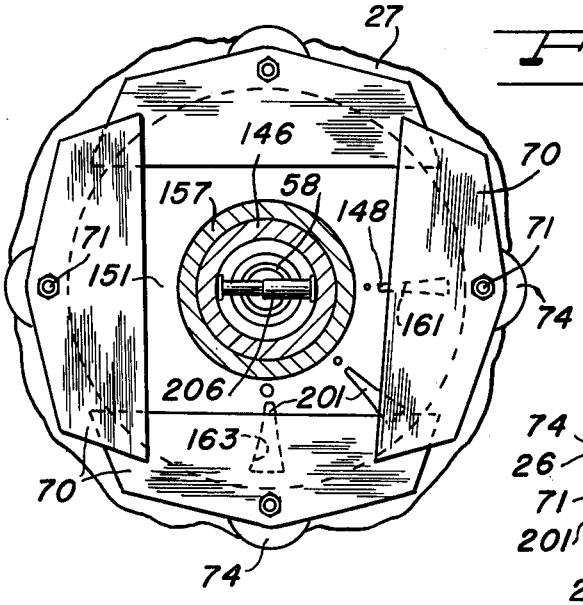
Fig-10
Fig-11
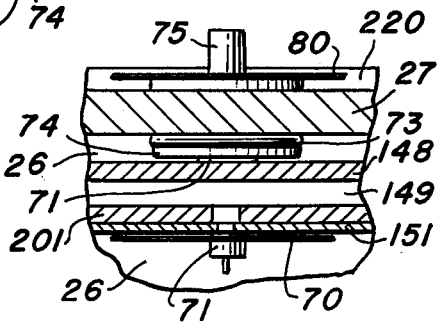

WATER SPRINKLER WITH FLAT PLATE PATTERN CONTROL

This application is a continuation-in-part of my copending application Ser. No. 51,861, filed June 25, 1979, which in turn is a continuation-in-part of my then copending application Ser. No. 893,268 filed Apr. 5, 1978, now issued as U.S. Pat. No. 4,180,210.

The present invention relates generally to water sprinklers and particularly to water sprinklers for producing a predetermined but easily variable pattern of water coverage.

Most known water sprinklers have been designed to produce only a single pattern of water coverage, generally either circular or rectangular. To conform the pattern of water coverage to the shape and area of a yard to be sprinkled, the only variables which can generally be adjusted are the location of the sprinkler and the water pressure received by the sprinkler. However, many yards are irregular in shape, thus making it difficult, if not impossible, to conform completely the pattern of water coverage to the size and geometry of the yard. Further, in some instances it is desireable to sprinkle only a selected portion of a yard or garden, and yet the pattern of water coverage cannot be accurately conformed to the geometry of such area. Consequently, either some water is wasted in covering areas not desired to be sprinkled or the water coverage must be reduced to cover only a portion of the desired areas. In either case, the results are not entirely satisfactory.

To generate an irregular pattern of water coverage, a water sprinkler has been previously proposed whose coverage is defined by a fixed plate having an orifice with a geometry corresponding to the geometry of water coverage desired. Thus, the geometry of the orifice roughly defines the pattern of water coverage. See U.S. Pat. No. 4,019,686, for example. In U.S. Pat. No. 2,739,839, a fixed sleeve with control ports and a rotating axle with a continuous inlet and auxillary ports define added areas about a circular pattern to be sprinkled. Adjustment screws permit some of the control ports to be partly blocked to vary the spray pattern.

A problem with the sprinkler proposed in the '086 patent is that the sprinkler must be disassembled each time the pattern of water coverage is to be changed substantially. That is, if the pattern of water coverage is to be changed from circular to rectangular, for example, a plate having a circular orifice must be removed and replaced by a plate having a rectangular orifice. Further, the simple slot sampler used does not give good pattern definition. In the '839 patent, up to eight screws and eight lock nuts must be adjusted, or a new control sleeve inserted, to adjust the water coverage pattern. As a result, in either case it is inconvenient or diffucult to change the pattern of water coverage.

Such problems associated with prior water sprinklers make it inconvenient, if not impossible, to vary the pattern of water coverage as closely as desired. In addition, much water is frequently wasted by sprinkling outside desired areas.

Accordingly, it is an object of this invention to provide an improved water sprinkler.

It is a more particular object of the invention to provide a water sprinkler whose water patterns are easily variable, which can effect virtually any desired coverage with simple adjustments to achieve irregular patterns of coverage in various sizes, and to allow ease of manufacture and repair of said sprinkler.

In accordance with the present invention, an improved water sprinkler has a fixed housing and carries a water outlet port. A control shell interposed in the housing between the water inlet and outlet ports cooperates with a plurality of individually adjustable flat plates disposed within the housing in facially sealing contact with a planar surface of the control shell. The control shell has at least one, and may have a plurality of, pattern-sampling apertures for passing water in controlled amounts. Each aperture is contoured to assure precise pattern definition. As the spray head angularly rotates, one pattern-sampling aperture on the control shell is variably covered by an edge of one or more of the pattern defining plates. Projected interior and exterior areas of the control shell are designed to provide a net upward force on the control shell dependent upon the water pressure within the shell, such pressure force causing an increased rotational drag to prevent any increased speed of rotation when longer-radius sectors are being sprayed, when the pressure within the control shell is greatest.

In the drawing figures:

FIG. 4 is a vertical sectional view similar to FIG. 1, showing a second embodiment of the invention;

FIGS. 5 and 6 are plan views of the water pressure selector disk and pattern sampling disk, taken on lines V—V and VI—VI of FIG. 4, respectively;

FIGS. 7 and 8 are detailed plan views, partly in section, on lines VII—VII and VIII—VIII of FIG. 4;

FIG. 9 is an elevational view on line IX—IX of FIG. 8;

FIG. 10 is a bottom plan view of the control shell and pattern-defining plates taken on line X—X of FIG. 4;

FIG. 11 is a elevational view, partly in section, taken on line XI—XI of FIG. 4;

FIG. 12 is a top plan view, partly in section, taken on line XII—XII of FIG. 4.

Figure 1:
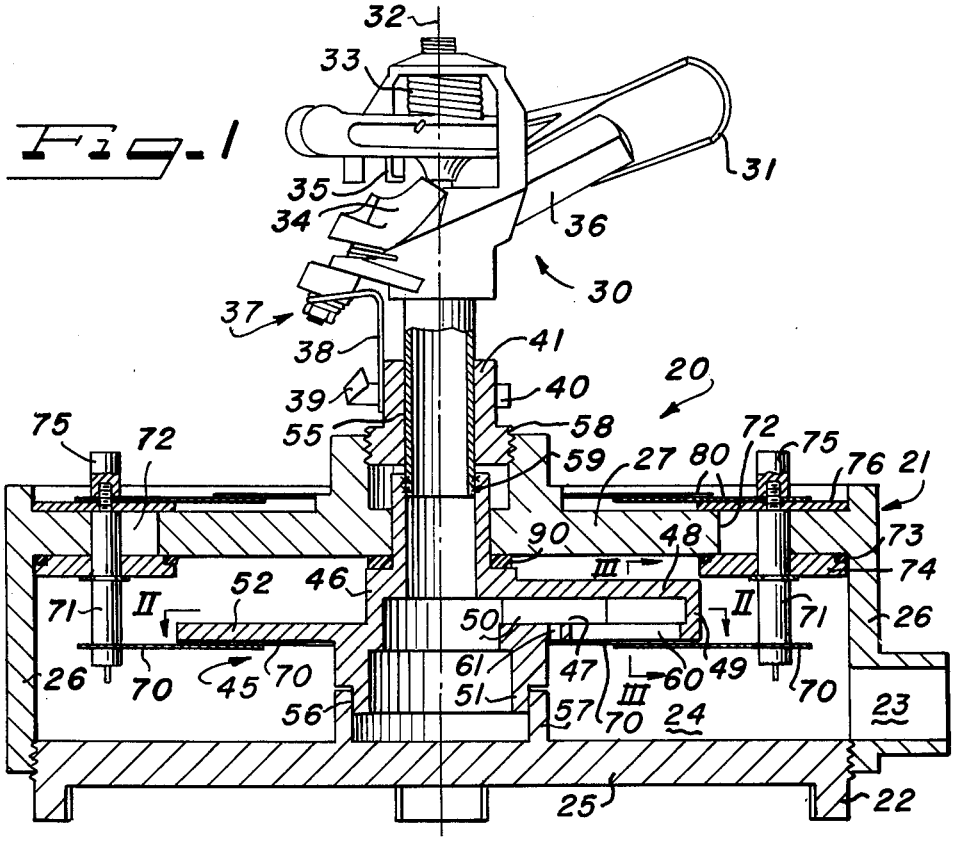
FIG. 1 is a vertical, cross-sectional view of a water sprinkler embodying one form of the present invention.

A vertical-axis water sprinkler in accordance with principles of the invention is shown in FIG. 1, at 20. The sprinkler 20 comprises a hollow housing 21 having lower feet 22 for resting upon a generally flat surface. The housing 21 has a water inlet port 23 for passing water under pressure into chamber 24 of the housing defined by a bottom wall 25, a circumferential wall 26, and a top wall 27. The walls 25, 26, and 27 have sufficient strength in and among them to safely contain the full pressure of water from the inlet port 23.

Arranged on a vertical axis and upstanding from the housing 21 is a rotatable and reciprocatable spray head 30, of known, conventional construction. A spray nozzle (hidden in the drawing) sprays into and through a weighted flapper assembly 31 which is journaled about a central axis 32 of the water sprinkler 20. Briefly, the flapper 31 is unstable in the stream of water from the nozzle, being first urged in the counterclockwise direction in the drawing by the stream of water impinging on the end thereof, and then being urged in the opposite direction by a coil spring 33. The flapper 31 strikes sharply and with some force upon either a counterclockwise-urging stop member 34, via stop pin 35, upon deflection by the water stream or upon clockwise-urging stop member 37 upon return of the flapper 31 into the water stream by the spring 33. Either of such striking contacts moves the spray head 30 about its axis 32 through a small angle. If the stop 34 is in contacting position, the flapper 31 has insufficient momentum upon returning to the stop 36 to force the spray head 30 to rotate in the opposite direction, and vice versa. As is well known, the counterclockwise stop 34 is moved into or out of contacting position with pin 35 by a direction-reversing assembly 37. The assembly 37 comprises a toggle 38 which may contact one or another of circumferentially-settable stops 39 and 40, carried on the fixed spray head support shaft 41. The toggle 38 may also be moved out of position, downwardly and to the left in FIG. 1, for full circle rotation of the head 30. If the toggle 38 is in the position shown in FIG. 1, however, the striking force of the flapper 31 will cause the direction reversing assembly 37 to move the contacting member 34 into or out of position for contact with pin 35, to reverse the direction of angular movement. U.S. Pat. No. 3,022,012, now expired, discloses a similar sprinkler head usable with the present invention. In this expired patent, a spray deflector is used which does not create a side spray effect, as does the described flapper 31; absence of side spray is advantageous in certain applications.

Carried by the sprinkler head 30 within the housing body 21 is a hollow control shell 45. The control shell 45 comprises a vertical center conduit 46 and a collection chamber 47. The chamber 47 is bounded by a top wall 48, a peripheral wall 49, side walls 50, and a lower, apertured disk segment 51. The disk segment 51 is continued 360 degrees about the axis 32, as apertured disk 52.

Upper and lower circumferential portions of the conduit wall 46 of the control shell 45 are journaled in the housing 21, at 55 and 56. Journal 56 is formed by an upstanding ring 57 formed on the bottom wall 25 of the housing 21. The journals 55 and 56 are lubricated by water in the housing 21 via permitted small leakages across and through said journals. The conduit 46 is affixed and sealed to conduit 58 leading to the spray head 30 as by an O-ring and a key or sonic weld 59, for corotation of the shell 45 and spray head 30.

Figure 2:
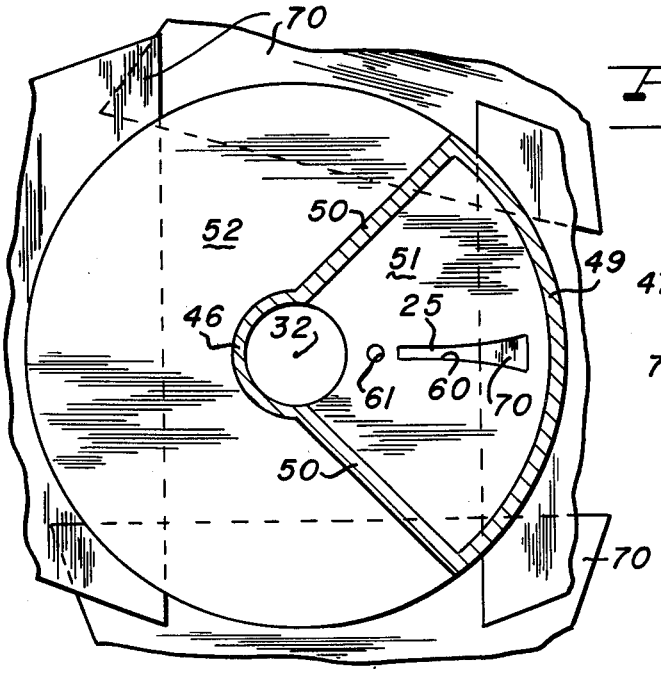
FIG. 2 is a plan view of the pattern sampling disk and pattern defining plates, on section II—II of FIG. 1.

Formed in the apertured sampling disk 51 in this embodiment of the invention is a pattern sampling aperture 60, as shown in FIGS. 1 and 2. This pattern sampling aperture 60 is specially contoured as shown to provide a larger water flow at larger-radius portions of the aperture. Such contour preserves pattern definition at high flow rates in the corners of rectangular yards, preventing both bulging and shrinking of the sides of the sprinkled pattern. Similar contouring of the pattern sampling apertures is shown in my second co-pending application no. 51,861, but a different rationale is involved in view of differences between sampling cylindrical versus flat apertures to create patterns of water coverage on flat ground surfaces. A supplemental aperture 61 guarantees a minimum flow through the disk segment 51 sufficient to move the flapper 31 and direction reverser assembly 37 of the spray head 30.

Figure 3:
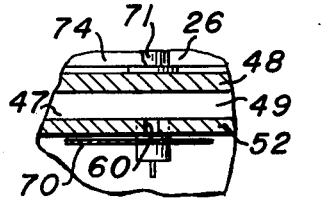
FIG. 3 is a sectional view taken on lines III—III of FIG. 1.

Selectively fixed with respect to the housing 21, and carried on the upper wall 27 thereof, is a series of flat pattern defining plates 70, as shown in FIGS. 1, 2, and 3. Each plate 70 is a thin sheet of corrosionresistant metal which is stiff but resilient. Each plate 70 is irrotatably carried upon a lower end of a shaft 71; the shaft 71 is pivotable and radially slideable in a slot 72 formed in the upper wall 27 of the housing. The slot 72 is sealed against loss of water from the interior chamber 24 of the housing by an O-ring 73 or other suitable sealing collar carried on a suitable mount 74 on the shaft 71. Movement and positioning of the shaft 71 is controlled by a thumb-nut 75 which is screw-threaded to the end of the shaft 71 accessible outside the housing. A further support structure 76 bears on the top of the wall 27 and seals the upper part of the slot 72.

Further in accordance with principles of the invention, an indicator plate 80 is carried irrotatably on each shaft 71 in overlying alignment with the interior pattern defining plate 70. Thus, in the orientation of FIG. 2, each indicator plate 80 will exactly overlie a corresponding one of the plates 70. Thus, a user of the sprinkler 20 may, after setting the sprinkler in a desired location in a yard, set the pattern defining plates 70 to the exact shape and size of the area to be sprinkled, by direct observation of the settings and positions of the exterior plates 80.

Further in accordance with the principles of the present invention, the speed of rotation of the spray head 30 about the axis 32 of the sprinkler is made uniform, despite variations in the radius of a sector being sprayed by slowing the movement of the head 30 in reverse proportion to the radius of the spray at any point about the axis 32. As is well known, reciprocating spray heads of the type shown travel more slowly at low flow rates than at high flow rates. Where a non-circular pattern is to be sprayed, such variations in speed cause uneven spray distribution about the pattern. Briefly, the speed of rotation is controlled by the water pressure inside the collection chamber 47 and in the axial flow conduit 46, which is a direct function of the thrust to be given to the spray of water from the sprinkler 20, or of the radius of water coverage selected. That is, given a fixed inlet pressure at the inlet port 23, a smaller radius of water distribution requires that the aperture 60 be more restricted by the plate 70. Such restriction creates a larger pressure drop across the sampling disk 61, so that pressure in the collection chamber 47 and conduit 46 is lowered. When the radius to be sprayed is larger, the plate 70 will cover radially less of the aperture 60, and due to contouring of the aperture, a relatively larger flow passage is exposed, creating less pressure drop across the sampling disk 51. A larger pressure then is developed inside the control shell 45.

Thus, according to this facet of the invention, the interior of the control shell 45 is downwardly open, about the axis 32, so that a net upward force is generated by pressure within the conduit 46 acting between the projected horizontal area of the conduit 46 and the bottom wall 25 of the housing 21 inwardly of the upstanding ring 57. The upper projected area of the exterior of the control shell 45 (exposed to pressure in the chamber 24) is somewhat larger, as shown, than the lower projected area. Net downward pressure on the exterior partly compensates for the upward pressure on the shell 45 from within the chamber avoiding imposing such friction force on the bearing 90 as to lock shell 45 against rotation at high flow rates.

A friction bearing 90, comprised for instance of a nylon or synthetic rubber substance having a moderate coefficient of friction in the presence of water, is interposed between the horizontal shoulder of the conduit 46 and the upper housing wall 27, as in FIG. 1. The bearing 90 may be attached to either surface, or may be split to create a friction zone between its own upper and lower halves. The coefficient of friction between the friction bearing 90 and the material of the conduit 46 or housing wall 27, as appropriate, is selected, together with the projected area of the horizontal parts of the interior of the conduit 46, to effect a reduced speed of rotation of the spray head 30 at larger radii and higher internal pressures than at lesser radii and lower internal pressures. Slowing the sprinkler head in sectors of larger-radius coverage patterns compensates for the tendancy of the head to speed up in such sectors, insuring more even deposit of water over such different sectors. Thus, by design selection of the sizes of the exterior and interior projections of the conduit 46 and of the materials of the friction bearing 90, modification of the normally-variable rotational speed of the head by using the internal water pressure as related to the area of water coverage is readily effected.

A second embodiment of the invention is shown in FIGS. 4–11. In this embodiment the housing body 21 and spray head 30 are substantially identical to that of the embodiment of FIGS. 1 through 3. The control shell is modified to permit accommodation of the sprinkler to different inlet water pressures at the port 23. In this second embodiment, the sprinkler 120 has a control shell 145 with a modified conduit 146. The collection chamber 147 has instead of a single contoured pattern sampling aperture 60 fixed in its lower wall, a single, oversized pressure selector aperture 200 formed in its lower wall 201.

Mounted in facially-sealing relation to the pressure selector wall or disk 201 is a pattern sampling disk 151 carrying a plurality of contoured pattern sampling apertures 161, 162, and 163, as shown in FIG. 6. More or fewer sampling apertures may be employed. Each sampling aperture 161–163 is contoured as described above and has a corresponding circular opening, as at 164, for assuring a minimum water flow from the spray head 30 at the various pressures. Contoured apertures 161–163 and the minimum-flow apertures corresponding to them communicate with the pressure selector aperture 200 upon selected axial alignment of same. The smaller aperture 161 is used with higher inlet water pressures, to create a larger pressure drop across the pattern sampling disk 151, while the larger aperture 163 is used with lower inlet water pressure to impart less of a pressure drop on water passing into the control shell 145. To some degree these apertures may also be used to vary the size of the pattern produced, but generally the outlet nozzle will limit the flow capacity at higher pressures in conduit 146.

Adjustment of the pressure selector disk 201 with respect to the pattern sampling disk 151 is accomplished by means of a pin and detent arrangement between them, together with a mechanism for selectively holding the pattern sampling disk 151 stationary with respect to the housing 21. As shown in FIGS. 4 and 7, the control shell conduit 146 has a bore 205 formed at a diameter thereof and aligned with the outlet nozzle and the selector aperture, for receiving a pin 206 which has an expansion spring fitted interiorly thereof for expanding the pin 206 to its full length. As shown in FIGS. 4 and 7, a downwardly depending ring 207 carried on the pattern sampling disk 151 has a series of cooperating indentations 208 corresponding to the circumferential positions of the pattern sampling apertures 161, 162, and 163. Ends of the spring-loaded pin 206 pass from ends of the bore 205 in the conduit 146 and engage the indentations 208 with sufficient force to prevent relative movement between the selector disk 201 and the sampling disk 151 during normal sprinkler operation.

To permit changing the axial alignment of the selector aperture 200 among the sampling apertures 161, 162, and 163, the upstanding ring 157 has a crown of teeth 210, as shown in FIGS. 4, 8, and 9. The downwardly depending ring 207 from the sampling disk 151 is similarly provided with cooperating teeth 211. When the sprinkler is in operation the teeth 210 and 211 are disengaged from one another, and the entire control shell 145 may rotate freely of the housing 21, except for the variable drag of the friction bearing 90. However, when it is desired to change the pressure drop across the pattern sampling disk 151 by aligning the selector aperture 200 with a different one of the sampling apertures 161–163, the spray head 30 is manually pressed downwardly sufficiently far to engage the teeth 211 on the pattern sampling disk 151 with the teeth 210 of the ring 157 attached to the lower housing wall 25. The disk 151 is thus immobilized. Turning the spray head 30 rotationally with respect to the housing 21 will move the ends of the detent bar 206 on the contoured shell 45 from the indentations 208 in the wall 207 of the sampling disk 151 until the ends are aligned with the next set of indentations 208 in the wall 207. Then the aperture 200 is aligned with a different one of the sampling apertures 161–163. Such relocation may be accomplished by feel or by any other convenient means of facilitation, such as by making the lower wall 25 of the housing of a clear plastic.

FIGS. 10 and 11 show additional views of the embodiment of FIG. 4, respectively from the underside of the control shell 145 and vertically through the collection chamber 147 and the various disks and apertures. Similarly, FIG. 12 is a downward view, showing the top of the sprinkler housing 21 of FIG. 4. The top wall 27 of the housing 21 conveniently has a rim 220 and a plurality of posts 221 spaced about it. The rim 220 and the posts 221 prevent the indicator plates 80, and thus the interior pattern defining plates 70, from taking any position beyond the maximum radius of the pattern sampling apertures 161–163.

Figure 13:
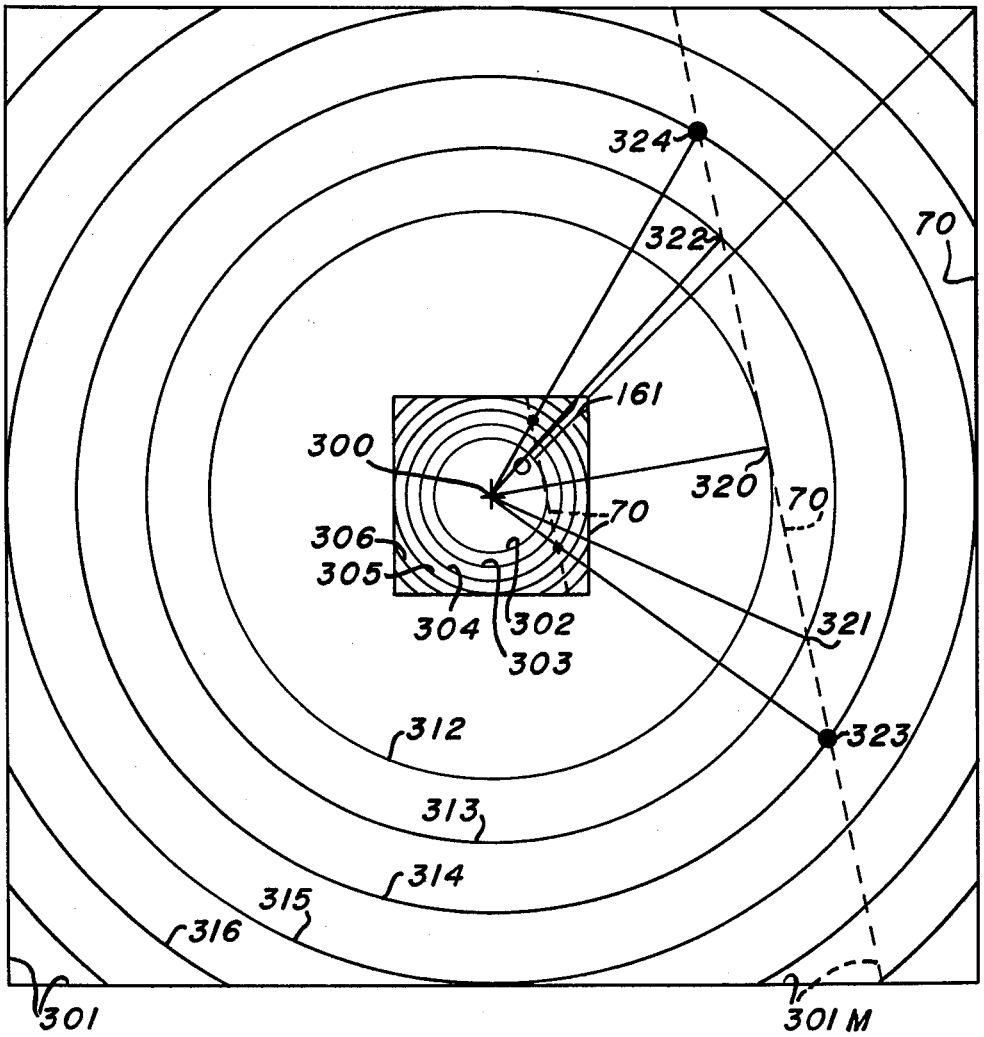
FIG. 13 is a diagramatic view of the patterns of spray coverage which can be developed with the sprinkler of the present invention.

In operation, as suggested in FIG. 13, the water sprinkler of the present invention is set for instance at a centerpoint 300 of an area 301 to be sprinkled. The area 301 may be a square as shown, or the area may be modified and limited to have any other regular or irregular shape as 301M, depending upon the adjustment of each of the pattern defining plates 70. The inner circles 302–306 in FIG. 13 index radial parts of the pattern sampling aperture. The water distribution circles 312–316 are those generated by the corresponding aperture parts. The edge of a plate 70 will cut off the water distribution beyond a given circle, at a given position about the axis 32. Water flowing through the aperture 161 in FIG. 4 or aperture 60 in FIG. 1 will pass from the spray nozzle outwardly only to the corresponding circle on the ground.

Thus, if a pattern defining plate 70 is moved radially inwardly, and pivoted as shown in the dashed lines in FIG. 13, it will limit the spray pattern as to line 370 along one boundary. In this case, the pattern defining aperture sends a minimum flow to position 320 in FIG. 13. The flow increases as the aperture rotates in either direction from position 320, as to points 321, 322, 323, and 324 on the next-larger circles 313, 314, corresponding with internal index circles 303, 304. Similarly, the top, left, and/or bottom plates 70 may also be moved inwardly or rotated on their shafts 71 to produce other sizes and patterns of water distribution. Further, as described in my second, prior application, setting the spinkler at a corner of a desired spray pattern and/or using the direction-reversal feature of the spray head can generate many other, often very irregular shapes.

Although various modifications may be made to the embodiments disclosed, as will be apparent to those skilled in the art, all such modifications and alterations are included within the spirit and scope of the invention. Therefore, the invention is to be limited and defined only by the appended claims taken in light of the specification above.

I claim as my invention:

1. A vertical-axis water sprinkler for distributing water in a stream or spray in a desired ground coverage pattern, the sprinkler having a housing with a water inlet, a spray head rotatable on a vertical axis and carried on said housing, means for rotating said spray head, a spray nozzle extending in a generally radial direction from said spray head, and an internal control means including a hollow rotatable shell communicating between said housing water inlet and said spray nozzle, the control means controlling the pattern of water distribution in said stream or spray, wherein the control means comprises:

a flat pattern sampling disk forming one axial surface of said rotatable shell and having surfaces forming a contoured sampling aperture which extends radially of the vertical axis of the spray head, is circumferentially enlarged at radially outermost portions thereof, and is aligned radially with the spray nozzle; and at least one pattern defining plate carried on said housing, each said pattern defining plate having a radially inwardmost edge spaced from the axis of the spray head and being positioned partially in substantially facially sealing relation to the pattern sampling disk, wherein said edge and a face of each said pattern defining plate lie adjacent the pattern sampling disk through at least a part of an arc of rotation of said spray head to block flow through selected radial portions of the sampling aperture depending on the circumferential position of the spray nozzle about the axis of the housing in said part of said arc and the radial position of the edge of each said plate at said spray nozzle position, whereby to provide a desired distribution pattern corresponding substantially identically to the shape of the central area about the sprinkler axis in said part of said arc left unobstructed by said pattern defining plate.

2. A vertical-axis water sprinkler as defined in claim 1, wherein the control means further comprises friction means for maintaining a constant rotational speed of the spray head and of the control means shell despite variations in radii of the pattern to be sprayed, said friction means comprising:

an axial flow channel in said control means shell having a first, horizontal cross-sectional area and communicating to the nozzle outlet;

a base chamber having a second cross-sectional area which is larger than the first cross-sectional area, the base of the chamber being formed in the control means shell and in the housing axially of said axial flow channel, said chamber being closed at its bottom by a portion of the housing base wall, at its lower circumference by an upstanding wall affixed to the housing base wall, at its upper circumference by a wall downwardly depending from the pattern sampling disk, and upwardly by horizontal portions of the interior control means flow passages; and a friction bearing interposed between the control means shell and the housing and having a coefficient of friction; and wherein the difference between the first and second cross-sectional areas is selected in view of said coefficient of friction to provide a desired lesser resistance to rotation of the spray head at minimum-radius sectors of the spray pattern as determined by said pattern-defining plate, when pressure inside the control means shell and consequent upward force on the shell are lowest, and to provide a desired greater resistance to rotation of the spray head at maximum-radius sectors of a spray pattern, when pressure inside the control means shell and upward force on the shell are higher, whereby to provide even water distribution over the ground coverage pattern.

3. A vertical-axis water sprinkler as defined in claim 1, wherein said control means comprises:

a plurality of said pattern-defining plates which are adjustably fixed in the housing in partially-overlying relation to one another about the axis of the head; and adjustment means affixed to each of said plates for selectively adjusting the radial and rotational position of each said plate in the housing and with respect to the pattern sampling disk.

4. A vertical-axis water sprinkler as defined in claim 3, wherein the adjustment means comprises a plurality of shafts each irrotatably affixed normally to one of said pattern defining plates, each said shaft extending from the housing into an external position for selective manual manipulation and setting of the position of each plate.

5. A vertical-axis water sprinkler as defined in claim 4, wherein each of said shafts carries irrotatably on its external end an indicator plate aligned with and having the same size and shape as the corresponding pattern defining plate, whereby to show directly the size and shape of the pattern of water distribution selected.

6. A vertical-axis water sprinkler as defined in claim 4, wherein the housing is formed with a radially-extending slot receiving each shaft and each said slot and shaft is sealed against water leakage by a seal surrounding on the shaft and engaging the housing wall in sealing contact.

7. A vertical-axis water sprinkler as defined in claim 3, wherein the pattern sampling disk further defines a circular aperture radially aligned with said pattern sampling aperture, said circular aperture lying short of the range of radially-inward adjustment of each of said pattern defining plates, whereby to insure a desired minimum flow through the spray nozzle at any circumferential position of the nozzle.

8. A vertical-axis water sprinkler as defined in claim 3, or in claim 7, wherein the spray head includes spray head rotation direction reversing means.

9. A vertical-axis water sprinkler as defined in claim 1, wherein:

the pattern sampling disk defines a plurality of sampling apertures of varying shapes and sizes, the apertures being spaced circumferentially about said sampling disk, and wherein the control means further comprises a pressure selector disk mounted in facially-sealing contact with said pattern sampling disk, the selector disk defining a single aperture which is aligned radially with the spray nozzle of the spray head, and wherein the pattern sampling disk is selectively adjustable rotationally with respect to the pressure selector disk to align axially any selected one of said pattern sampling apertures with said aperture in the pressure selector disk, whereby to allow flow through said one selected pattern sampling aperture dependent on the shape and size of the aperture aligned with the selector disk aperture and the radial position of each said pattern defining plate edge about the axis of the housing.

10. A vertical-axis water sprinkler as defined in claim 9, wherein the control means further comprises friction means for maintaining the rotational speed of the spray head and of the control means shell at various radii of the pattern to be sprayed, said friction means comprising:

an axial flow channel in said control means shell having a first, horizontal cross-sectional area and communicating to the nozzle outlet;

a base chamber having a second cross-sectional area which is larger than the first cross-area, the base of the chamber being formed in the control means shell and in the housing axially of said axial flow channel, said chamber being closed at its bottom by a portion of the housing base wall, at its lower circumference by an upstanding wall affixed to the housing base wall, at its upper circumference by a wall downwardly depending from the pressure selector disk, and upwardly by horizontal portions of the interior control means flow passages; and a friction bearing interposed between the control means shell and the housing and having a coefficient of friction; and wherein the difference between the first and second cross-sectional areas is selected in view of said coefficient of friction to provide a desired lesser resistance to rotation of the spray head at minimum-radius sectors of the spray pattern as determined by said pattern-defining plate when pressure inside the control means shell and consequent upward force on the shell are lowest, and to provide a desired greater resistance to rotation of the spray head at maximum-radius sectors of a spray pattern, when pressure inside the control means shell and upward force on the shell are higher, whereby to provide even water distribution over the ground coverage pattern.

11. A vertical-axis water sprinkler as defined in claim 9, wherein the pattern sampling disk and the pressure selector disk are selectively fixed in position with regard to one another by a pin and detent means arranged between said two disks.

12. A vertical-axis water sprinkler as defined in claim 11, wherein one of the pattern sampling disk and the pressure selector disk carries means for selectively irrotatably engaging the housing, whereby forced manual rotation of the spray head while said one disk is immobilized disengages the pin and detent means from one circumferential position to another, to align the pressure selector aperture with a desired one of the pattern sampling apertures.

13. A vertical-axis water sprinkler comprising a hollow housing with an inlet port, a spray head rotatable on said axis and carrying an outlet nozzle at a radial position thereon, means for rotating said spray head, and control means inside the housing for limiting the flow through the housing to spray water only in a desired adjustable and resettable pattern about the sprinkler, wherein the control means comprises:

a hollow shell defining a vertical conduit about said axis and a collection chamber rotatable about said axis, both in communication to said outlet nozzle;

said collection chamber having a flat, axially-facing wall with at least one elongated, radially extending aperture formed therein communicating said collection chamber to the interior of said housing and to said inlet port; and a plurality of pattern defining plates adjustably fixed in said housing in facially-sealing contact with said apertured wall of the collection chamber, each of said plates lying adjacent a circumferential arc segment of the wall and being movable with respect to said wall and to each other to block flow through selected portion of said radial aperture within said arc segment, whereby the control means defines an area of a selected shape about said axis which is swept by the aperture and which is not blocked by any of said plates, said area corresponding in relative size and in shape to the area to be sprayed by the sprinkler.

14. A vertical-axis water sprinkler as defined in claim 13, wherein said aperture in contoured to flare smoothly circumferentially outwardly at larger-radius portions thereof, whereby to improve definition of the pattern of water spray coverage.

15. A vertical-axis water sprinkler as defined in claim 13, wherein the flat collection chamber wall defines a plurality of apertures each of a different shape and size, and the control means further comprises an aperture selector disk having a single aperture and carried on said chamber wall, and angular adjustment means for selecting one of the apertures for passing flow into said chamber and for blocking flow through others.

16. A vertical-axis water sprinkler as defined in claim 13, further comprising means including friction bearing means and pressure surface means within said hollow shell for limiting the speed of rotation of the control means shell and spray nozzle when pressure within said shell is high and for maintaining the speed of rotation when said pressure is low, when long- and short-radius spray areas are traversed, respectively.

17. A method of spraying water in a desired pattern of ground coverage using a vertical-axis sprinkler with a rotating spray head, comprising the steps:

aligning, with a radial direction of a spray of water from said spray head to said pattern, a radially-extending sampling aperture formed in a horizontal disk rotating with said spray head, the sampling aperture having a circumferentially enlarged width at radially outward portions;

passing a flow of water through said sampling aperture from a source of water to said spray head; and blocking said flow of water through a selected, radially outward portion of said aperture in at least a part of an arc of rotation of said spray head, the unblocked portion at each circumferential position of the spray head and sampling aperture being in direct relation to the corresponding radius of the pattern of ground coverage desired in said part of said arc, such that the shape of the unblocked portion is geometrically substantially identical in shape to the pattern of ground coverage desired in said part of said arc.

18. A method of spraying water as defined in claim 17, further comprising the steps:

adjustably fixing a plate in said sprinkler in facially sealing relation to said disk, the plate having an edge and a face which are swept by the sampling aperture as the spray head rotates; and adjusting and readjusting the position of the edge of said plate in the sprinkler to correspond to the distance and/or the angular orientation of a corresponding side edge of the pattern of ground coverage desired.

19. A method of spraying as defined in claim 17, further comprising the steps:

adjusting the resistance to rotation of the spray head as a function of the radius of spray by increasing the force on a friction bearing acting on the spray head when pressure drop across the sampling aperture is decreased and by decreasing the force on said bearing when pressure drop across the sampling aperture is increased, thereby to maintain a substantially constant speed of rotation of the spray head in relation to the sprinkler, to obtain an even distribution of water despite variations in the radius of spray about a pattern.

* * * * *

REEXAMINATION CERTIFICATE (432nd)

United States Patent [19]

DeWitt

[11] B1 4,281,793

[45] Certificate Issued Dec. 10, 1985

[54] WATER SPRINKLER WITH FLAT PLATE PATTERN CONTROL

[76] Inventor: Robert E. DeWitt, 49 Sherwick Rd., Oswego, Ill. 60543

Reexamination Request:
No. 90/000,245, Aug. 23, 1982

Reexamination Certificate for:

| | |
|---|---|
| Patent No.: | **4,281,793** |
| Issued: | **Aug. 4, 1981** |
| Appl. No.: | **115,263** |
| Filed: | **Jan. 25, 1980** |

Related U.S. Application Data

[63] Continuation-in-part of Ser. No. 51,861, Jun. 25, 1979, Pat. No. 4,269,354, which is a continuation-in-part of Ser. No. 893,268, Apr. 5, 1978, Pat. No. 4,180,210.

[51] Int. Cl.[4] ..... B05B 3/06

[52] U.S. Cl. ..... 239/11; 239/97; 239/230; 239/252; 239/396; 239/DIG. 1

[56] References Cited

U.S. PATENT DOCUMENTS

| | | | |
|---|---|---|---|
| 2,600,987 | 6/1952 | Gallice | 239/97 |
| 2,619,388 | 11/1952 | Wahlin | 239/DIG. 1 |
| 2,739,839 | 3/1956 | Greener et al. | 239/97 |
| 3,424,381 | 1/1969 | Best | 239/97 |
| 3,575,347 | 4/1971 | Carlson | 239/97 |
| 3,884,416 | 5/1975 | King | 239/DIG. 1 |
| 4,019,686 | 4/1977 | Palma | 239/DIG. 1 |

*Primary Examiner*—Jeffrey V. Nase
*Assistant Examiner*—Michael J. Forman

[57] ABSTRACT

A vertical-axis water sprinkler with a reversibly rotating spray head has an internal control shell rotating with the spray head in a fixed housing. Adjustably fixed in the housing are a plurality of pattern defining plates. A pattern sampling disk with a specially contoured aperture therein is carried on a control shell within the housing and communicates from a water inlet in the housing to the spray head. The aperture sweeps across the face and edge of each of the pattern defining plates as the control shell rotates in the housing. The positions of the pattern defining plates control or limit the volume of water flow to the spray head, thereby generating a ground coverage pattern conforming to the relative positions of the plates.

The speed of rotation of the spray head is made constant despite changes in the output flow rate by design selection of a friction bearing and of the surface areas of the control shell exposed to pressure forces in upward and downward directions.

Water supply pressure variations are accommodated in one embodiment by a plurality of pattern sampling apertures in a sampling disk coupled to a pressure selector disk having a single aperture radially aligned with the spray nozzle of the sprinkler head. Momentary engagement of the sampling disk to the housing permits rotating the spray head affixed to the control shell to change the aperture selected.

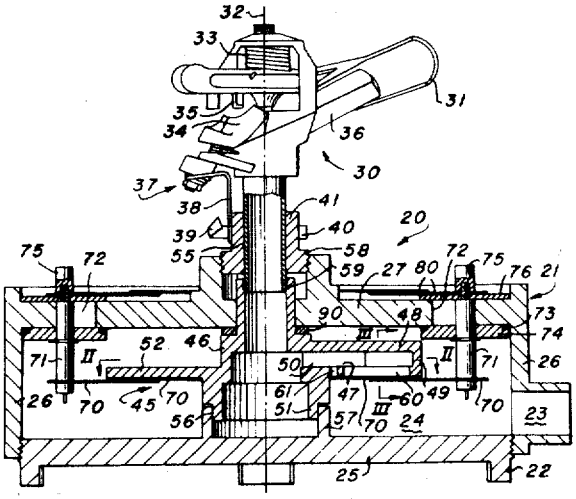

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 2-16, 18 and 19 is confirmed.

Claims 1 and 17 are cancelled.

* * * * *